US010357670B2

(12) United States Patent
Wu

(10) Patent No.: US 10,357,670 B2
(45) Date of Patent: Jul. 23, 2019

(54) SPEED REDUCER ARRANGEMENT FOR A LINE RETRACTION DEVICE

(71) Applicant: MSA (SUZHOU) Safety Equipment R&D Co., Ltd., Suzhou (CN)

(72) Inventor: Aimei Wu, Suzhou (CN)

(73) Assignee: MSA (Suzhou) Safety Equipment R&D Co., Ltd., Suzhou (CN)

( * ) Notice: Subject to any disclaimer, the term of this patent is extended or adjusted under 35 U.S.C. 154(b) by 85 days.

(21) Appl. No.: 15/549,791

(22) PCT Filed: Feb. 14, 2016

(86) PCT No.: PCT/CN2016/073758
§ 371 (c)(1),
(2) Date: Aug. 9, 2017

(87) PCT Pub. No.: WO2016/127946
PCT Pub. Date: Aug. 18, 2016

(65) Prior Publication Data

US 2018/0028844 A1 Feb. 1, 2018

(30) Foreign Application Priority Data

Feb. 13, 2015 (CN) ..... 2015 1 0080358

(51) Int. Cl.
*A62B 1/10* (2006.01)
*B65H 75/44* (2006.01)
(Continued)

(52) U.S. Cl.
CPC ..... *A62B 1/10* (2013.01); *A62B 35/0093* (2013.01); *B65H 75/4439* (2013.01); *B65H 75/48* (2013.01)

(58) Field of Classification Search
CPC ..... B65H 75/4439; B65H 75/48; A62B 1/10; A62B 35/0093
See application file for complete search history.

(56) References Cited

U.S. PATENT DOCUMENTS 2,896,912 A 7/1959 Gabriel et al.
3,901,457 A * 8/1975 Turesson ..... A01K 89/01557 242/289
(Continued)

FOREIGN PATENT DOCUMENTS

CN 1220173 A 6/1999
CN 200978165 Y 11/2007
(Continued)

*Primary Examiner* — William A. Rivera
(74) *Attorney, Agent, or Firm* — The Webb Law Firm

(57) ABSTRACT

A speed reducer arrangement (200) for a line retraction device (100), including at least one lug (4) fixed on a surface of a rotatable hub (2) and configured to rotate along with the hub (2); at least one brake shoe (5) having at least one groove (8) extending therethrough and configured to at least partially receive the at least one lug (4), such that, as the hub (2) rotates, the at least one brake shoe (5) is configured to slidably move along the at least one groove (8) from an inactivated position, wherein the at least one brake shoe (5) is located nearest the center of the hub (2) to an activated position, wherein the at least one brake shoe (5) contacts at least one contact surface of the line retraction device (100) to thereby slow the rotation of the hub (2); and at least one biasing member (6) configured to urge the at at least one brake shoe (5) towards the inactivated position.

20 Claims, 13 Drawing Sheets

(51) Int. Cl.
*B65H 75/48* (2006.01)
*A62B 35/00* (2006.01)

(56) References Cited

U.S. PATENT DOCUMENTS

| | | | | | |
|---|---|---|---|---|---|
| 4,359,139 | A | | 11/1982 | Bloder | |
| 4,487,380 | A | * | 12/1984 | King | B65H 75/4434 242/381.5 |
| 4,582,179 | A | * | 4/1986 | Nelson | B65H 75/4447 185/39 |
| 5,630,249 | A | * | 5/1997 | Rebai, Jr. | E05F 1/16 16/77 |
| 6,416,001 | B1 | * | 7/2002 | Chang | A01K 89/0155 188/181 A |
| 8,813,914 | B2 | * | 8/2014 | Rinklake | A62B 1/10 182/234 |
| 9,656,832 | B2 | * | 5/2017 | Morgan | B65H 75/4447 |
| 2005/0178872 | A1 | * | 8/2005 | Hyun | A01K 89/0155 242/611 |
| 2012/0298784 | A1 | * | 11/2012 | Morgan | B65H 75/4447 242/381.5 |

FOREIGN PATENT DOCUMENTS

| | | | |
|---|---|---|---|
| CN | 201248972 | Y | 6/2009 |
| GB | 756793 | | 9/1956 |
| WO | 2014119805 | A1 | 8/2014 |

* cited by examiner

SPEED REDUCER ARRANGEMENT FOR A LINE RETRACTION DEVICE

CROSS REFERENCE TO RELATED APPLICATIONS

This application is the National Stage of International Patent Application No. PCT/CN2016/073758, filed Feb. 14, 2016, which claims priority to Chinese Application No. 201510080358.4, filed on Feb. 13, 2015, entitled "A SPEED REDUCER", the entire contents of which are hereby incorporated by reference.

BACKGROUND OF THE INVENTION

Field of the Invention

The present invention relates generally to safety systems and arrangements and, in particular, to a line retraction device, such as a fall arrest or controlled descent device, including self-retracting lanyards and the like, which may be used in connection with a harness to protect the wearer from a sudden, accelerated fall arrest event, as well as a speed reducer arrangement for a line retraction device.

Description of the Related Art

A line retraction device may be used in a variety of situations and applications. For example, one type of line retraction device is in the form of a lanyard, such as a self-retracting lanyard (SRL), which is commonly used for fall protection in industrial environments, as well as in connection with recreational activities. Self-retracting lanyards are used in numerous industrial markets, including, but not limited to, construction, manufacturing, hazardous materials/remediation, asbestos abatement, spray painting, sand blasting, welding, mining, numerous oil and gas industry applications, electric and utility, nuclear energy, paper and pulp, sanding, grinding, stage rigging, roofing, scaffolding, telecommunications, automotive repair and assembly, warehousing, and railroading.

SRLs frequently include a housing that includes a rotatable drum or hub around which a line, typically made of webbing, cable, rope, and/or synthetic material is wound. The hub rotates to release (or "payout") the line from its housing when a certain level of tension is purposefully applied. When that degree of tension is reduced or released, the hub can slowly rotate in a reverse direction causing the line to retract or rewind about itself in a desired manner. Certain housings further include a braking mechanism or assembly for resisting hub rotation when an inelastic line (e.g., a steel cable) unwinds too rapidly, i.e., faster than its predetermined maximum velocity for normal payout. A sudden line payout is an indication that the lanyard wearer/user has experienced a fall that needs to be stopped or arrested.

During an unintentional, accidental fall, an engagement and braking arrangement in the housing of the SRL engages, which prevents the SRL wearer from falling too far. In addition, SRLs typically connect at one end to an anchorage point, often on the support structure at or near where a user is performing certain assigned tasks. The line from the SRL housing is clamped (or otherwise attached) to a harness worn by the user. The maximum allowable stopping forces and distances are defined by known industry standards. The stopping force provided by a brake is inversely proportional to the stopping distance, i.e., the higher the force, the shorter the distance, and vice versa. As a result, the force cannot exceed the maximum allowed by standards, and yet it must also be large enough so that the extension distance does not exceed the maximum, also regulated by these standards.

The hub of the SRL is biased to retract the line back into the housing of the SRL. As noted above, the line will payout from the hub as the user walks away from the SRL and will also retract back into the housing as the user walks toward the SRL. When a user disconnects the line from their harness and releases the line, "freewheeling" can occur, which is the unrestrained retraction of the line back into the housing of the SRL. When the end of the line reaches the SRL, an end connector on the line can impact the housing of the SRL and damage the housing, the end connector, and/or the internal components of the SRL. Such an impact may also jam the SRL requiring the repair of the SRL and, in some circumstances, injure the user. The issues caused by the impact of the end connection against the housing may create a dangerous condition where the SRL may not function properly the next time it is used. Proper line retraction is typically controlled by the user either directly by hand or indirectly with a tag line secured to the main line of the SRL.

SUMMARY OF THE INVENTION

Generally, provided are an improved line retraction device, such as a self-retracting lanyard, and an improved speed reducer arrangement for use in connection with a line retraction device. Preferably, provided are an improved line retraction device and speed reducer arrangement therefore that effectively reduce the speed of rotation of a rotatable hub of the line retraction device during retraction or release of the line based upon the speed of rotation.

Accordingly, and in one preferred and non-limiting embodiment or aspect, provided is a speed reducer arrangement for a line retraction device having a hub configured to rotate about a center axis and having a line associated therewith, the line including a first end directly or indirectly attached to the hub and a second end opposite the first end, and at least one retraction member biasing the hub in a first rotational direction of the hub opposite a second rotational direction of the hub, wherein the hub is configured to: (i) retract the line when the hub moves in the first rotational direction; and (ii) release the line when the hub moves in the second rotational direction, wherein the speed reducer arrangement comprises: at least one lug fixed on a surface of the hub and configured to rotate along with the hub; at least one brake shoe having at least one groove extending therethrough and configured to at least partially receive the at least one lug, such that, as the hub rotates, the at least one brake shoe is configured to slidably move along the at least one groove from an inactivated position, wherein the at least one brake shoe is located nearest the center of the hub, to an activated position, wherein the at least one brake shoe contacts at least one contact surface of the line retraction device to thereby slow the rotation of the hub; and at least one biasing member configured to urge the at least one brake shoe towards the inactivated position.

In one preferred and non-limiting embodiment or aspect, the line retraction device comprises at least one housing at least partially surrounding the hub, wherein the at least one contact surface comprises at least one surface of the at least one housing.

In one preferred and non-limiting embodiment or aspect, the at least one groove extends at an angle with respect to a line connecting a center point of the at least one groove and the center axis of the hub. In another preferred and non-limiting embodiment or aspect, the angle is an acute angle, and the degree of the acute angle is selected such that the speed at which the at least one brake shoe moves from the inactivated position to the activated position when the hub moves in the second rotational direction is greater than the speed at which the at least one brake shoe moves from the inactivated position to the activated position in the first rotational direction. In another preferred and non-limiting embodiment or aspect, the angle is an acute angle in the range of about 0° to about 60°, and in another preferred and non-limiting embodiment or aspect, the acute angle is in the range of about 15° to about 30°. In another preferred and non-limiting embodiment or aspect, the speed reducer arrangement comprises a plurality of brake shoes radially spaced about the center axis of the hub, wherein the angle for each of the plurality of brake shoes is substantially identical.

In one preferred and non-limiting embodiment or aspect, the force of engagement between the at least one brake shoe and the at least one contact surface of the line retraction device is proportional to the speed at which the hub is rotating.

In one preferred and non-limiting embodiment or aspect, the speed reducer arrangement comprises at least one holding groove configured to receive the at least one brake shoe, such that the at least one brake shoe can slide from the inactivated position to the activated position. In another preferred and non-limiting embodiment or aspect, the speed reducer arrangement comprises a plurality of holding grooves configured to receive a respective one of a plurality brake shoes, wherein the angle between a line connecting a center point of each of adjacent holding grooves and the center axis of the hub is about 90°. In another preferred and non-limiting embodiment or aspect, the radial length of the at least one brake shoe is from about 1 mm to about 5 mm shorter than the radial distance from a bottom edge of the at least one holding groove and the at least one contact surface of the line retraction device.

In one preferred and non-limiting embodiment or aspect, the at least one biasing member is attached between at least a portion of the at least one brake shoe and at least one of the following: at least a portion of the hub, at least a portion of at least one other brake shoe, or any combination thereof, such that the at least one brake shoe is urged towards the inactivated position.

In one preferred and non-limiting embodiment or aspect, the speed reducer arrangement comprises a plurality of brake shoes radially spaced about the center axis of the hub, wherein the at least one biasing member comprises a plurality of members, each of which is attached between two of the plurality of brake shoes.

In one preferred and non-limiting embodiment or aspect, the length of the at least one groove is in the range of about ½ to about ⅘ the radial length of the at least one brake shoe.

In one preferred and non-limiting embodiment or aspect, the at least one lug is fixed to the surface of the hub by at least one attachment member.

In one preferred and non-limiting embodiment or aspect, the at least one biasing member is at least one spring.

In one preferred and non-limiting embodiment or aspect, provided is a line retraction device, comprising: a hub configured to rotate about a center axis and having a line associated therewith, the line including a first end directly or indirectly attached to the hub and a second end opposite the first end; at least one retraction member biasing the hub in a first rotational direction of the hub opposite a second rotational direction of the hub, wherein the hub is configured to: (i) retract the line when the hub moves in the first rotational direction; and (ii) release the line when the hub moves in the second rotational direction; and a speed reducer arrangement, comprising: (i) at least one lug fixed on a surface of the hub and configured to rotate along with the hub; (ii) at least one brake shoe having at least one groove extending therethrough and configured to at least partially receive the at least one lug, such that, as the hub rotates, the at least one brake shoe is configured to slidably move along the at least one groove from an inactivated position, wherein the at least one brake shoe is located nearest the center of the hub, to an activated position, wherein the at least one brake shoe contacts at least one contact surface of the line retraction device to thereby slow the rotation of the hub; and (iii) at least one biasing member configured to urge the at least one brake shoe towards the inactivated position.

In one preferred and non-limiting embodiment or aspect, the line retraction device comprises at least one housing at least partially surrounding the hub, and wherein the at least one contact surface comprises at least one surface of the at least one housing.

In one preferred and non-limiting embodiment or aspect, the force of engagement between the at least one brake shoe and the at least one contact surface of the line retraction device is proportional to the speed at which the hub is rotating.

In one preferred and non-limiting embodiment or aspect, the at least one groove extends at an angle with respect to a line connecting a center point of the at least one groove and the center axis of the hub.

In one preferred and non-limiting embodiment or aspect, the angle is an acute angle, and the degree of the acute angle is selected such that the speed at which the at least one brake shoe moves from the inactivated position to the activated position when the hub moves in the second rotational direction is greater than the speed at which the at least one brake shoe moves from the inactivated position to the activated position.

In one preferred and non-limiting embodiment or aspect, the speed reducer arrangement comprises a hub though an axis and a housing, wherein: at least one lug relatively fixed to the hub is arranged on the hub, and the lug is contained in a corresponding centrifugal brake shoe which has a guiding groove, so that the centrifugal brake shoe can slide along the guiding groove under the constraint of the lug, and the centrifugal brake shoe can rub against the inner surface of the housing when it is moving out along the guiding groove in the direction away from the axis due to the centrifugal force; the angle between the length direction of the guiding groove and the connection line connecting the center of the guiding groove and the axis of the hub is acute, wherein, when there is more than one centrifugal brake shoe, and the connection line connecting the center of each guiding groove and the axis of the hub is set as a start edge and the length direction of the guiding groove is set as a terminal edge, the terminal edge always deflects to the same clockwise or counterclockwise direction as the start edge; a reset device is arranged on the circumferential direction of the hub to reset each centrifugal brake shoe.

In one preferred and non-limiting embodiment or aspect, when the rotating speed of the hub is lower, such as when the line is still attached to a user, the centrifugal brake shoes still try to move away from the axis due to the centrifugal force, but the centrifugal force is too small to overcome the radial force towards the axis caused by the biasing member. Therefore, when the centrifugal brake shoes are positioned nearest to the axis, a radial gap exists between the centrifugal brake shoes and the adjacent inner surface of the housing. They will not contact each other, and therefore, the speed reducer arrangement will not have the decelerating effect. When the rotating speed of the hub is high, the centrifugal force on the centrifugal brake shoes is large enough to overcome the radial force towards the axis caused by the biasing member, therefore the centrifugal brake shoes are no longer positioned nearest to the axis but move out along a hollow groove in the direction away from the axis under the constraint of the lugs. When the rotating speed of the hub keeps increasing and the centrifugal brake shoes and the inner surface of the housing touch, they will create friction against each other, so that the centrifugal brake shoes will decelerate due to the friction resistance. The deceleration of the centrifugal brake shoes will lead to the deceleration of the hub, because the lugs relatively fixed to the hub are contained in the long guiding grooves of the centrifugal brake shoes. The faster the hub is rotating, the higher the centrifugal force will be on the centrifugal brake shoes. Since friction is in direct proportion to normal pressure, the friction between the centrifugal brake shoes and the inner surface of the housing is increasing due to the increasing of the normal pressure thereof, thus higher friction is provided when the hub is rotating at a high rotating speed. Conversely, when the rotating speed of the hub becomes lower, the friction becomes smaller, and the centrifugal brake shoes will move back to the position nearest to the axis when the centrifugal force is too small to overcome the radial force towards the axis caused by the reset device. As indicated above, the speed reducer arrangement can automatically adjust the deceleration friction resistance with the change of the rotating speed of the hub, by providing larger friction resistance when the rotating speed of the hub is higher to ensure the decelerating effect, as well as providing smaller or no friction resistance when the rotating speed is lower to ensure the normal rotation of the hub.

In one preferred and non-limiting embodiment or aspect, when the hub is rotating clockwise or counterclockwise, the critical speeds to move the centrifugal brake shoes from the position nearest to the axis are different. For example, the critical speed is lower when rotating in one direction (e.g. clockwise/retracting), while the critical speed is higher when rotating in the opposite direction (e.g. counterclockwise/releasing). The speed reducer arrangement comprises an acute angle between the length direction of the long guiding grooves and the connection line connecting the center of the long guiding groove and the axis of the hub. For example, it is expected that the critical speed when rotating clockwise is lower than the critical speed when rotating counterclockwise. When the hub is rotating clockwise, it increases the effect of the centrifugal brake shoes moving away from the axis, because the centrifugal brake shoes receive the counterclockwise circumferential force from the direction of the long guiding grooves to move away from the axis, as well as the centrifugal force to radially move away from the axis. Conversely, when the hub is rotating counterclockwise, it decreases the effect of the centrifugal brake shoes moving away from the axis, because the centrifugal brake shoes receive the clockwise circumferential force from the direction of the long guiding grooves to move toward the axis, as well as the centrifugal force to radially move away from the axis. This indicates that the critical speed to move the centrifugal brake shoes from the position nearest to the axis when rotating clockwise and releasing is higher than the critical speed to move the centrifugal brake shoes from the position nearest to the axis when rotating counterclockwise and retracting. The difference between the clockwise critical speed and the counterclockwise critical speed increases with the increase of the degree of the acute angle between the length direction of the long guiding grooves and the connection line connecting the center of the long guiding groove and the axis of the hub. Therefore, the difference between the clockwise critical speed and the counterclockwise critical speed can be effectively adjusted by adjusting the degree of the acute angle. More specifically, the bigger the degree of the acute angle is, the bigger the difference.

In one preferred and non-limiting embodiment or aspect, at least one holding groove is arranged on the hub in radial direction. Each of the centrifugal brake shoes is contained in a corresponding holding groove. The centrifugal brake shoes can be positioned more accurately by setting the holding groove, so that the force can be applied more evenly on the centrifugal brake shoes.

In one preferred and non-limiting embodiment or aspect, one end of the reset device is disposed on the hub, while the other end is disposed on the end of the centrifugal brake shoe on non-axis side by the division of the extension line of the guiding groove. Accordingly, the reset of the centrifugal brake shoes can be reliably implemented because the radial force towards the axis of the hub caused by the reset device is applied on the centrifugal brake shoes.

In one preferred and non-limiting embodiment or aspect, the reset device is disposed between the adjacent ends of the adjacent centrifugal brake shoes when there are more than two centrifugal brake shoes. The reset device here does not need to be fixed on the hub, and therefore it has the advantages of simple installation and maintenance.

In one preferred and non-limiting embodiment or aspect, each of the holding grooves is arranged evenly on the circumference when there is more than one holding groove. Each of the centrifugal brake shoes in the holding grooves is arranged evenly as the holding grooves are arranged evenly. Therefore, each of the centrifugal brake shoes can decelerate synchronously, and the hub will have an even force and will not clash the axis.

In one preferred and non-limiting embodiment or aspect, the guiding grooves in the length direction are straight. The benefit of the straight long guiding grooves is that they are easy to manufacture. In one preferred and non-limiting embodiment or aspect, the lugs are straight, which can better fit the straight long guiding grooves.

In one preferred and non-limiting embodiment or aspect, the length of the long guiding grooves is ½ to ⅘ of the radial length of the centrifugal brake shoes. The length of the guiding grooves is selectable. The longer the selected length, the higher the free moving range of the centrifugal brake shoes is obtained.

In one preferred and non-limiting embodiment or aspect, the acute angle between the length direction of the long guiding grooves and the connection line connecting the center of the long guiding groove and the axis of the hub is larger than 0° and less than or equal to 60°. In one preferred and non-limiting embodiment or aspect, the acute angle between the length direction of the long guiding grooves and the connection line connecting the center of the long guiding groove and the axis of the hub is larger than or equal to 15° and less than or equal to 30°. With regard to the choice of the acute angle degree, in one aspect, it can properly adjust the strength of the radial force towards the axis generated by the reset device; in another aspect, it can also properly adjust the difference between the critical speed to move the centrifugal brake shoes from the position nearest to the axis when rotating clockwise and the critical speed when rotating counterclockwise. The higher the angle degree is, the higher the critical speed difference.

In one preferred and non-limiting embodiment or aspect, each of the acute angles has the same degree. Therefore, each of the centrifugal brake shoes can decelerate synchronously during decelerating, so that the hub will have an even force and will not clash the axis.

In one preferred and non-limiting embodiment or aspect, the lugs are fixed on the hub by screws. The fixation of screws is secure and easy to repair.

In one preferred and non-limiting embodiment or aspect, the number of the holding grooves is four, and the angle between the connection line connecting the center of the adjacent holding grooves and the axis is 90°. Therefore, each pair of the two centrifugal brake shoes arranged symmetrically can perform the effect of dynamic balance, so that the hub will keep balance during decelerating.

In one preferred and non-limiting embodiment or aspect, the reset devices are springs. The reset springs are highly standardized, easy to derive and repair.

In one preferred and non-limiting embodiment or aspect, the radial length of the centrifugal brake shoes is 1 mm to 5 mm shorter than the radial distance from the bottom of the holding grooves to the inner surface of the housing, and the radial distance can be properly selected according to the size and usage of the particular speed reducer.

In one preferred and non-limiting embodiment or aspect, the long guiding grooves are long hollow grooves with the benefit of easy manufacture.

In one preferred and non-limiting embodiment or aspect, the speed reducer arrangement may also comprise a hub through the axis and a housing, wherein: at least one guiding groove is arranged on the hub, and a lug relatively fixed to the corresponding centrifugal brake shoe is contained in a guiding groove, so that the centrifugal brake shoe can slide along the guiding groove under the constraint of the lug, and the centrifugal brake shoe can rub against the inner surface of the housing when the centrifugal brake shoe is moving out along the guiding groove in the direction away from the axis due to the centrifugal force; the angle between the length direction of the guiding groove and the connection line connecting the center of the guiding groove and the axis of the hub is acute, wherein, when there is more than one centrifugal brake shoe, and the connection line connecting the center of each long guiding groove and the axis of the hub is set as a start edge and the length direction of the long guiding grooves is set as a terminal edge, the terminal edge always deflects to the same clockwise or counterclockwise direction as the start edge; and a reset device being arranged on the circumferential direction of the hub to reset each centrifugal brake shoe. To compare with the above-mentioned technical solution, in which the long guiding grooves are arranged on the centrifugal brake shoes and the lugs are arranged on and relatively fixed to the hub in the speed reducer arrangement, one difference of the speed reducer arrangement is that the guiding grooves are arranged on the hub and the lugs are arranged on and relatively fixed to the centrifugal brake shoes.

Further preferred and non-limiting embodiments or aspects of the present invention are described in the following numbered clauses:

Clause 1: A speed reducer arrangement for a line retraction device having a hub configured to rotate about a center axis and having a line associated therewith, the line including a first end directly or indirectly attached to the hub and a second end opposite the first end, and at least one retraction member biasing the hub in a first rotational direction of the hub opposite a second rotational direction of the hub, wherein the hub is configured to: (i) retract the line when the hub moves in the first rotational direction; and (ii) release the line when the hub moves in the second rotational direction, wherein the speed reducer arrangement comprises: at least one lug fixed on a surface of the hub and configured to rotate along with the hub; at least one brake shoe having at least one groove extending therethrough and configured to at least partially receive the at least one lug, such that, as the hub rotates, the at least one brake shoe is configured to slidably move along the at least one groove from an inactivated position, wherein the at least one brake shoe is located nearest the center of the hub, to an activated position, wherein the at least one brake shoe contacts at least one contact surface of the line retraction device to thereby slow the rotation of the hub; and at least one biasing member configured to urge the at least one brake shoe towards the inactivated position.

Clause 2: The speed reducer arrangement of clause 1, wherein the line retraction device comprises at least one housing at least partially surrounding the hub, and wherein the at least one contact surface comprises at least one surface of the at least one housing.

Clause 3: The speed reducer arrangement of clause 1 or 2, wherein the at least one groove extends at an angle with respect to a line connecting a center point of the at least one groove and the center axis of the hub.

Clause 4: The speed reducer arrangement of any of clauses 1-3, wherein the angle is an acute angle, and wherein the degree of the acute angle is selected such that the speed at which the at least one brake shoe moves from the inactivated position to the activated position when the hub moves in the second rotational direction is greater than the speed at which the at least one brake shoe moves from the inactivated position to the activated position.

Clause 5: The speed reducer arrangement of any of clauses 1-4, wherein the angle is an acute angle in the range of about 0° to about 60°.

Clause 6: The speed reducer arrangement of any of clauses 1-5, further comprising a plurality of brake shoes radially spaced about the center axis of the hub, wherein the angle for each of the plurality of brake shoes is substantially identical.

Clause 7: The speed reducer arrangement of any of clauses 1-6, wherein the force of engagement between the at least one brake shoe and the at least one contact surface of the line retraction device is proportional to the speed at which the hub is rotating.

Clause 8: The speed reducer arrangement of any of clauses 1-7, further comprising at least one holding groove configured to receive the at least one brake shoe, such that the at least one brake shoe can slide from the inactivated position to the activated position.

Clause 9: The speed reducer arrangement of any of clauses 1-8, further comprising a plurality of holding grooves configured to receive a respective one of a plurality brake shoes, wherein the angle between a line connecting a center point of each of adjacent holding grooves and the center axis of the hub is about 90°.

Clause 10: The speed reducer arrangement of any of clauses 1-9, wherein the radial length of the at least one brake shoe is from about 1 mm to about 5 mm shorter than the radial distance from a bottom edge of the at least one holding groove and the at least one contact surface of the line retraction device.

Clause 11: The speed reducer arrangement of claim 1-10, wherein the at least one biasing member is attached between at least a portion of the at least one brake shoe and at least one of the following: at least a portion of the hub, at least a portion of at least one other brake shoe, or any combination thereof, such that the at least one brake shoe is urged towards the inactivated position.

Clause 12: The speed reducer arrangement of any of clauses 1-11, further comprising a plurality of brake shoes radially spaced about the center axis of the hub, wherein the at least one biasing member comprises a plurality of biasing members, each of which is attached between two of the plurality of brake shoes.

Clause 13: The speed reducer arrangement of any of clauses 1-12, wherein the length of the at least one groove is in the range of about ½ to about ⅘ the radial length of the at least one brake shoe.

Clause 14: The speed reducer arrangement of any of clauses 1-13, wherein the at least one lug is fixed to the surface of the hub by at least one attachment member.

Clause 15: The speed reducer arrangement of clause 1-14, wherein the at least one biasing member is at least one spring.

Clause 16: A line retraction device, comprising: a hub configured to rotate about a center axis and having a line associated therewith, the line including a first end directly or indirectly attached to the hub and a second end opposite the first end; at least one retraction member biasing the hub in a first rotational direction of the hub opposite a second rotational direction of the hub, wherein the hub is configured to: (i) retract the line when the hub moves in the first rotational direction; and (ii) release the line when the hub moves in the second rotational direction; and a speed reducer arrangement, comprising: (i) at least one lug fixed on a surface of the hub and configured to rotate along with the hub; (ii) at least one brake shoe having at least one groove extending therethrough and configured to at least partially receive the at least one lug, such that, as the hub rotates, the at least one brake shoe is configured to slidably move along the at least one groove from an inactivated position, wherein the at least one brake shoe is located nearest the center of the hub, to an activated position, wherein the at least one brake shoe contacts at least one contact surface of the line retraction device to thereby slow the rotation of the hub; and (iii) at least one biasing member configured to urge the at least one brake shoe towards the inactivated position.

Clause 17: The line retraction device of clause 16, further comprising at least one housing at least partially surrounding the hub, and wherein the at least one contact surface comprises at least one surface of the at least one housing.

Clause 18: The line retraction device of clause 16 or 17, wherein the force of engagement between the at least one brake shoe and the at least one contact surface of the line retraction device is proportional to the speed at which the hub is rotating.

Clause 19: The line retraction device of any of clauses 16-18, wherein the at least one groove extends at an angle with respect to a line connecting a center point of the at least one groove and the center axis of the hub.

Clause 20: The speed reducer arrangement of any of clauses 16-19, wherein the angle is an acute angle, and wherein the degree of the acute angle is selected such that the speed at which the at least one brake shoe moves from the inactivated position to the activated position when the hub moves in the second rotational direction is greater than the speed at which the at least one brake shoe moves from the inactivated position to the activated position.

Still further preferred and non-limiting embodiments or aspects of the present invention are described in the following numbered clauses:

Clause 1: A speed reducer, comprising a hub through an axis and a housing, wherein: at least one lug relatively fixed to the hub is arranged on the hub, and the lug is contained in a corresponding centrifugal brake shoe which has a long guiding groove, so that the centrifugal brake shoe can slide along the guiding grooves under the constraint of the lug, and the centrifugal brake shoe can come in contact against the inner surface of the housing when it is moving out along the guiding groove in the direction away from the axis due to the centrifugal force; the angle between the length direction of the guiding groove and the connection line connecting the center of the guiding groove and the axis being acute, wherein, when there is more than one centrifugal brake shoe, and the connection line connecting the center of each long guiding groove and the axis of the hub is set as a start edge and the length direction of the long guiding groove is set as a terminal edge, the terminal edge always deflects to the same clockwise or counterclockwise direction as the start edge; and a reset device is arranged on the circumferential direction of the hub to reset each centrifugal brake shoe.

Clause 2: The speed reducer of clause 1, wherein the hub comprises at least one holding groove in the radial direction, and each of the centrifugal brake shoes is contained respectively in the corresponding holding groove.

Clause 3: The speed reducer of clause 1 or 2, wherein one end of the reset device is disposed on the hub, while the other end is disposed on the end of the centrifugal brake shoes on a non-axis side by the division of the extension line of the long guiding grooves.

Clause 4: The speed reducer of any of clauses 1-3, wherein the reset device is arranged between the adjacent ends of the adjacent centrifugal brake shoes when there are more than two centrifugal brake shoes.

Clause 5: The speed reducer of any of clauses 1-4, wherein each of the holding grooves is arranged evenly on the circumference when there is more than one holding groove.

Clause 6: The speed reducer of any of clauses 1-5, wherein the long guiding grooves in the length direction are straight.

Clause 7: The speed reducer of any of clauses 1-6, wherein the length of the long guiding grooves is ½ to ⅘ of the radial length of the centrifugal brake shoes.

Clause 8: The speed reducer of any of clauses 1-7, wherein the acute angle between the length direction of the long guiding grooves and the connection line connecting the center of the long guiding groove and the axis of the hub is larger than 0° and less than or equal to 60°.

Clause 9: The speed reducer of any of clauses 1-8, wherein the acute angle between the length direction of the long guiding grooves and the connection line connecting the center of the long guiding groove and the axis of the hub is larger than or equal to 15° and less than or equal to 30°.

Clause 10: The speed reducer of any of clauses 1-9, wherein the lugs are straight.

Clause 11: The speed reducer of any of clauses 1-10, wherein each of the acute angles has the same degree.

Clause 12: The speed reducer of any of clauses 1-11, wherein the lugs are fixed on the hub by screws.

Clause 13: The speed reducer of any of clauses 1-12, wherein the number of the holding grooves is four, and the angle between the connection line connecting the center of the adjacent holding grooves and the axis is 90°.

Clause 14: The speed reducer of any of any of clauses 1-13, wherein the reset device is reset springs.

Clause 15: The speed reducer of any of clauses 1-14, wherein the radial length of the centrifugal brake shoes is 1 mm to 5 mm shorter than the radial distance from the bottom of the holding grooves to the inner surface of the housing.

Clause 16: The speed reducer of any of clauses 1-15, wherein the long guiding grooves are long hollow grooves.

Clause 17: A speed reducer comprising a hub through an axis and a housing, wherein: at least one long guiding groove is arranged on the hub, and a lug relatively fixed to the corresponding centrifugal brake shoe is contained in each of the long guiding grooves, so that the centrifugal brake shoes can slide along the long guiding grooves under the constraint of the lugs, and the centrifugal brake shoes can rub against the inner surface of the housing when the centrifugal brake shoes are moving out along the long guiding grooves in the direction away from the axis due to the centrifugal force; the angle between the length direction of each long guiding groove and the connection line connecting the center of the long guiding groove and the axis of the hub being acute, wherein, when there is more than one centrifugal brake shoe, and the connection line connecting the center of each long guiding groove and the axis of the hub is set as a start edge and the direction of the length of the long guiding grooves is set as a terminal edge, the terminal edge always deflects to the same clockwise or counterclockwise direction as the start edge; and a reset device is arranged on the circumferential direction of the hub to reset each centrifugal brake shoe.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

Some of the advantages and features of the preferred aspects or embodiments of the invention have been summarized herein above. These embodiments, along with other potential aspects or embodiments of the invention, will become apparent to those skilled in the art when referencing the following drawings in conjunction with the detailed descriptions as they relate to the figures.

DETAILED DESCRIPTION OF THE INVENTION

Figure 1:
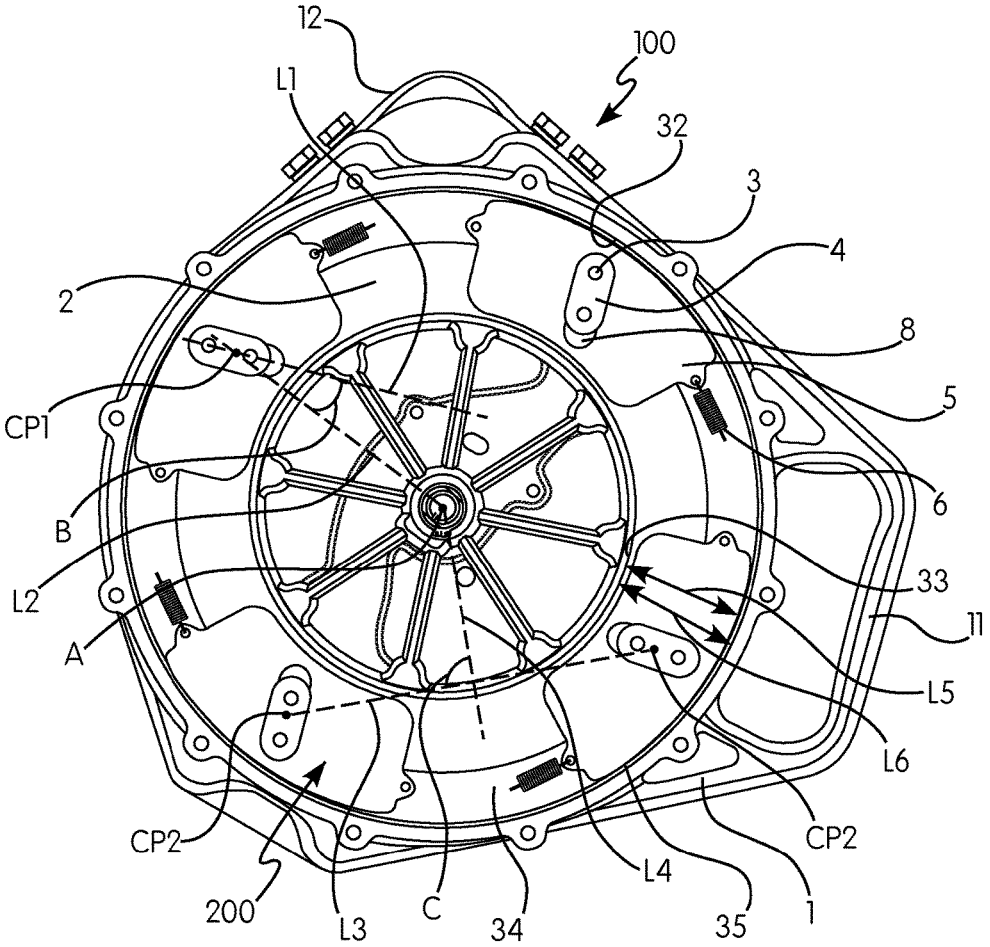
FIG. 1 is a schematic view of one embodiment of a line retraction device with a speed reducer arrangement in an inactivated position according to the principles of the present invention.
Figure 2:
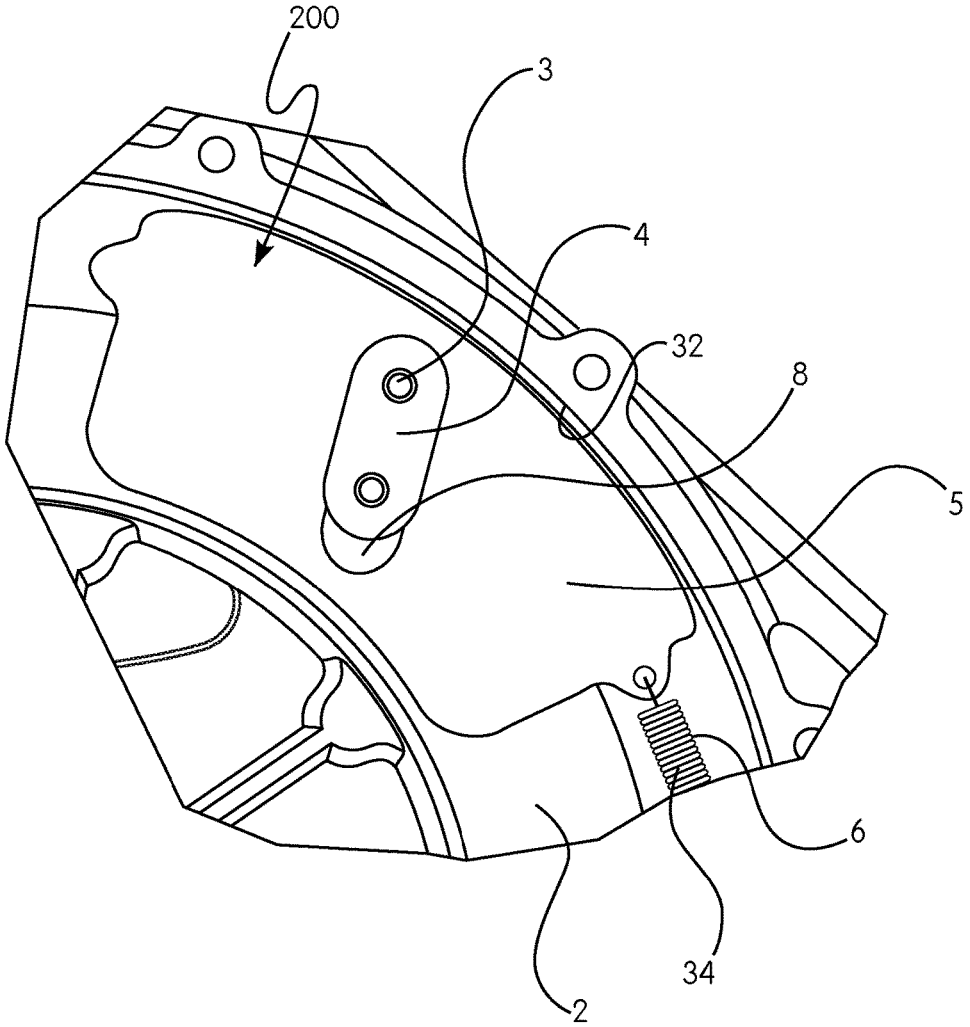
FIG. 2 is a partial enlarged view of a portion of the line retraction device with a speed reducer arrangement of FIG. 1.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step or stage sequences, except where expressly specified to the contrary. It is also to be understood that the specific devices and processes illustrated in the attached drawings, and described in the following specification, are simply exemplary embodiments or aspects of the invention. Hence, specific dimensions and other physical characteristics related to the embodiments or aspects disclosed herein are not to be considered as limiting.

The present invention is directed to a line retraction device 100 and a speed reducer arrangement 200 for such a line retraction device 100, as illustrated in certain preferred and non-limiting embodiments or aspects and in schematic form in FIGS. 1-13. The line retraction device 100 may be in the form of a lanyard, a self-retracting lanyard, and/or a fall protection device.

Figure 8:
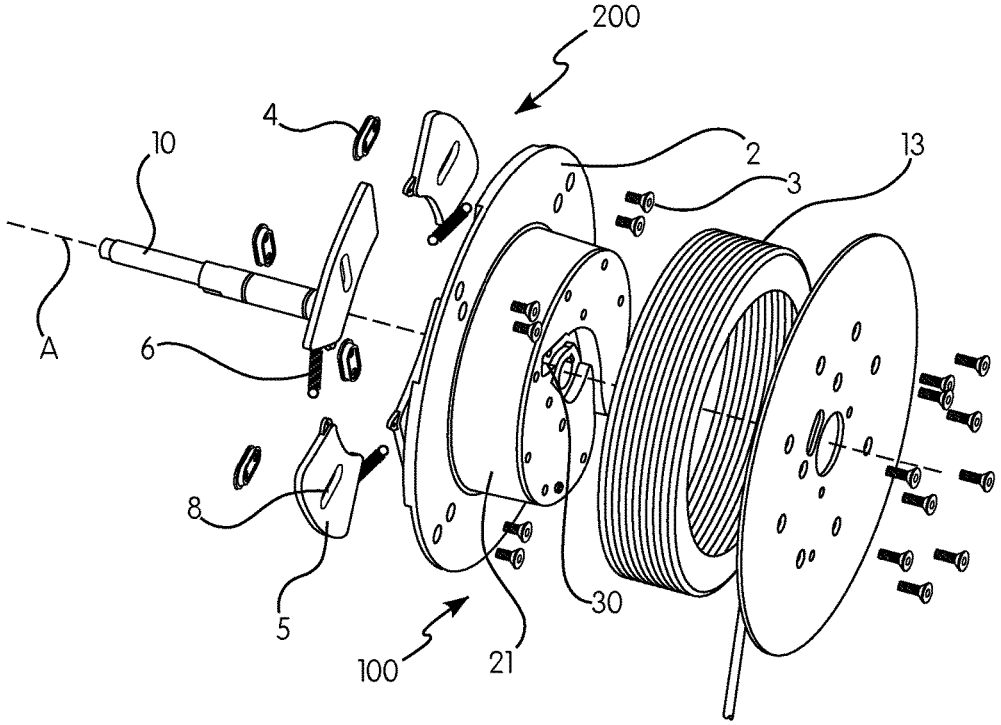
FIG. 8 is an exploded, perspective view of the line retraction device with a speed reducer arrangement of FIG. 1 illustrating a shaft and a line of the line retraction device.
Figure 9:
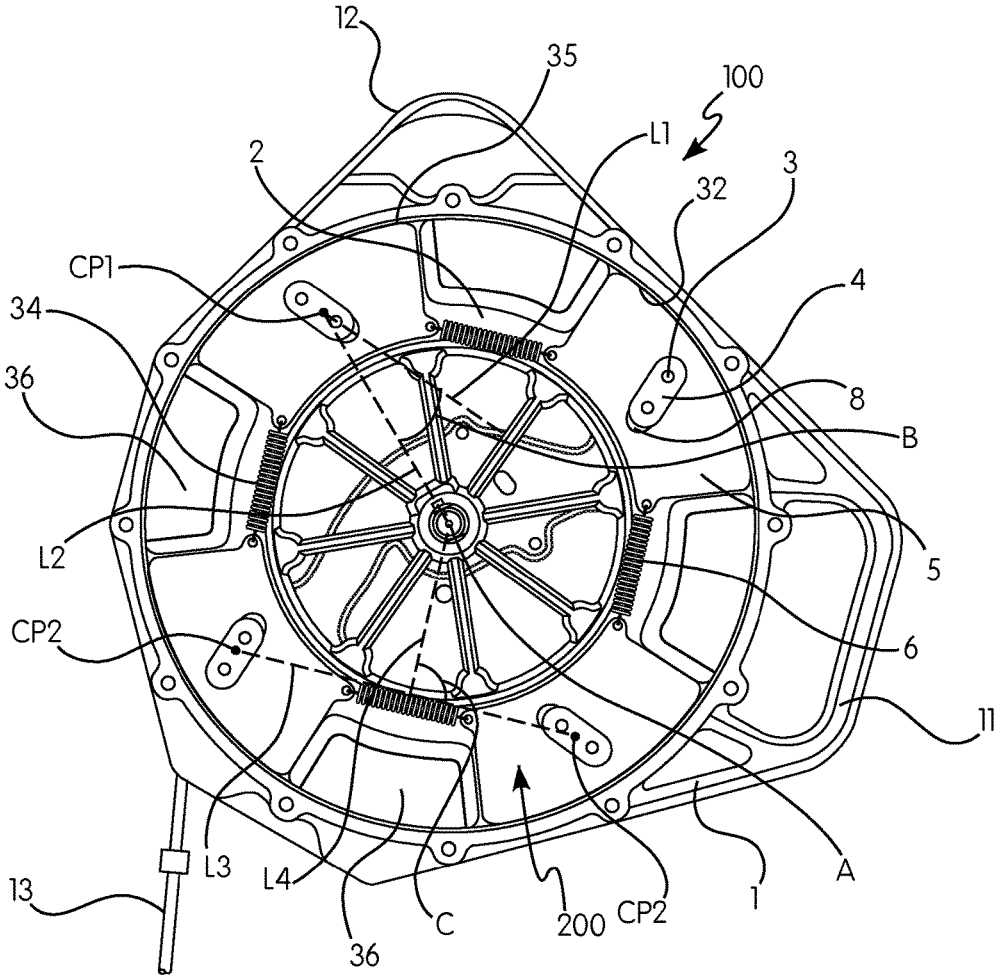
FIG. 9 is a schematic view of another embodiment of a line retraction device with a speed reducer arrangement in an inactivated position according to the principles of the present invention.
Figure 10:
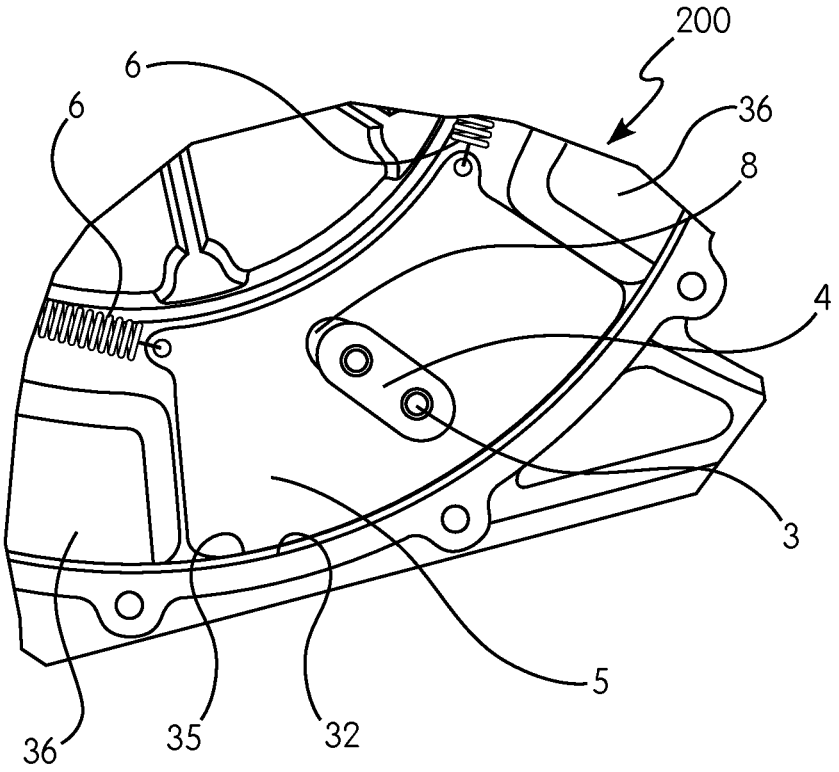
FIG. 10 is a partial enlarged view of a portion of the line retraction device with a speed reducer arrangement of FIG. 9.
Figure 13:
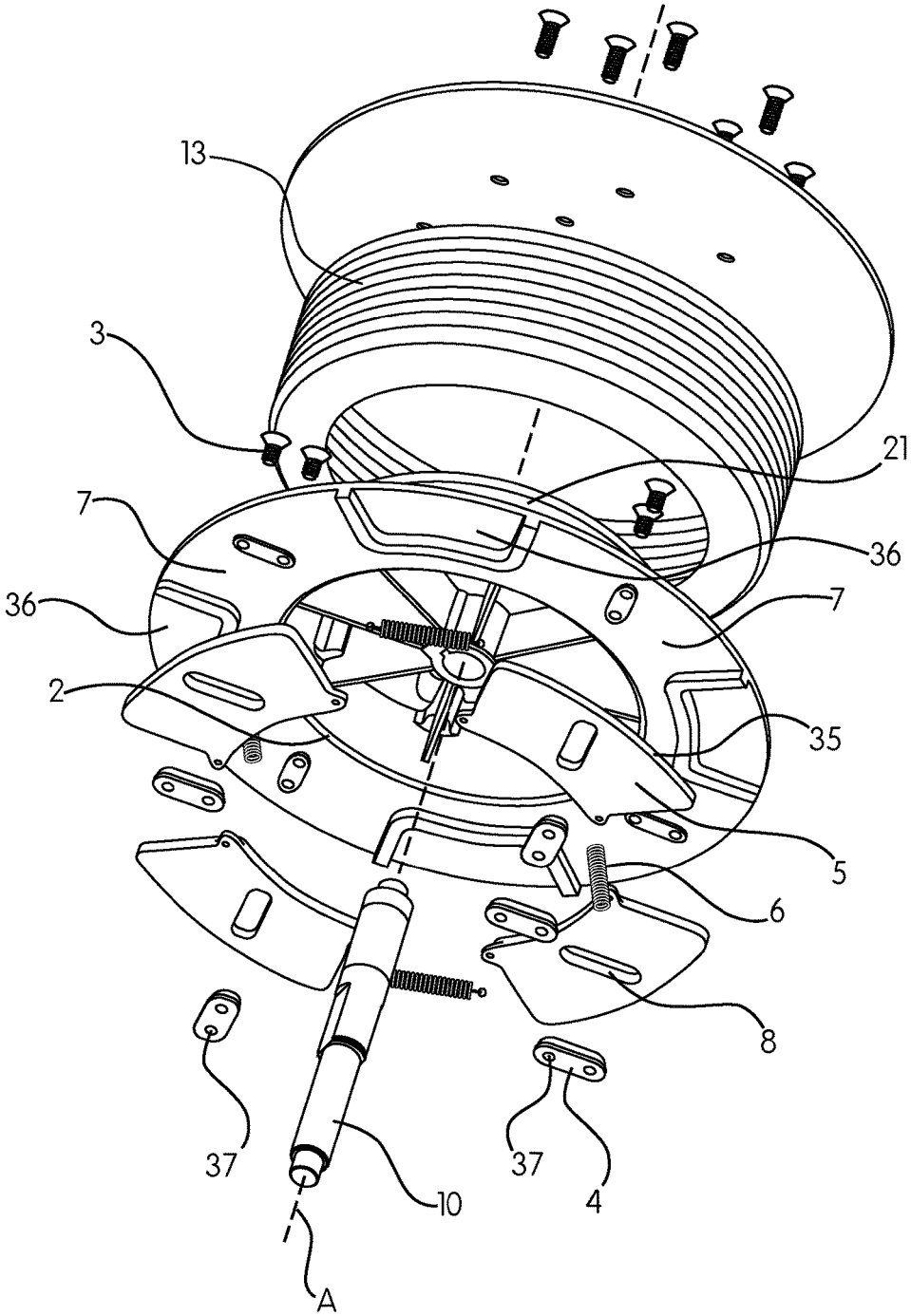
FIG. 13 is an exploded, perspective view of the line retraction device with a speed reducer arrangement of FIG. 9 illustrating a shaft and a line of the line retraction device.

Accordingly, and in one preferred and non-limiting embodiment or aspect, provided is a speed reducer arrangement 200 for a line retraction device 100. With reference to FIGS. 1, 8, and 13, the line retraction device 100 includes a hub 2 configured to rotate about a center axis (A). The hub 2 includes a winding section 21, and a line 13, such as a cable, a web, an elongated member, or the like, that is wrapped around or wound about the winding section 21. The line 13 is includes a first end directly or indirectly attached to the hub 2 (such as in the groove 30 on the hub 2 (see FIG. 8)) and a second end, opposite the first end, having an attachment member (not shown) for removable attachment to a user, e.g., a harness arrangement worn by the user. In addition, and in one preferred and non-limiting embodiment or aspect, the line retraction device 100 includes at least one retraction member (not shown) biasing the hub in a first rotational direction of the hub 2 opposite a second rotational direction of the hub 2, wherein the hub 2 is configured to: (i)

retract the line 13 when the hub 2 moves in the first rotational direction (e.g., the clockwise direction); and (ii) release (or pay out) the line 13 when the hub 2 moves in the second rotational direction (e.g., the counterclockwise direction). When the winding section 21 of the hub 2 is retracting or releasing the line 13, the hub 2 rotates about the shaft 10 (which, in one preferred and non-limiting embodiment or aspect, defines the center axis (A)). It is recognized that, in some embodiments, the shaft 10 rotates with the hub 2, and in other embodiments, the hub 2 rotates around the shaft 10, i.e., the shaft 10 is stationary with respect to the rotating hub 2. It will be apparent to those of ordinary skill in the art that any arrangement in reverse or symmetrical adjustment of the inner structure of the line retraction device 100 or the speed reducer arrangement 200 of the present invention may be made to the disclosed embodiments without departing from the spirit and scope of the invention, and fall into the protection scope of the invention.

Referring to FIGS. 1-4 and 9-12 and in one preferred and non-limiting embodiment or aspect, the line retraction device 100 includes a housing 1, which includes a generally hollow interior and contains the speed reducer arrangement 200 and other internal components of the line retraction device 100, such as the hub 2. Further, this housing 1 is considered stationary with respect to the moving components of the line retraction device 100. In one preferred and non-limiting embodiment or aspect, the housing 1 includes an internal surface that serves as an at least one contact surface 32. This at least one contact surface 32 may be made from or coated with a frictional material, such as a material with a high coefficient of friction. An anchor 12, which may be made of a line or other connection arrangement, is positioned on the housing 1 for hanging or positioning the line retraction device 100 during use and operation. Further, a handle 11 may be positioned on the housing 1, such that the line retraction device 100 can be easily transported or carried when not in use.

In one preferred and non-limiting embodiment or aspect, the speed reducer arrangement 200 includes at least one lug 4 fixed (such as by at least one attaching member 3) on a surface of the hub 2 and configured to rotate along with the rotatable hub 2, and at least one brake shoe 5 having at least one groove 8 extending therethrough and configured to at least partially receive the at least one lug 4, such that, as the hub 2 rotates, the at least one brake shoe 5 is configured to slidably move along the at least one groove 8 from an inactivated position, wherein the at least one brake shoe 5 is located nearest the center of the hub 2 (e.g., the center axis (A)) (see FIGS. 1, 2, 9, and 10), to an activated position, wherein the at least one brake shoe 5, e.g., a contact edge 35 of the at least one brake shoe 5, contacts the at least one contact surface 32 of the line retraction device 100 to thereby slow the rotation of the hub 2 (see FIGS. 3, 4, 11, and 12). The speed reducer arrangement 200 further includes at least one biasing member 6 configured to urge the at least one brake shoe 5 towards the inactivated position. In this manner, and as the hub 2 rotates (in either the first rotational direction or the second rotational direction), the at least one brake shoe 5 experiences centrifugal force, which, when high enough to overcome the urging force of the at least one biasing biasing member 6, the at least one brake shoe 5 (e.g., the contact edge 35) moves towards and contacts the at least one contact surface 32. Based upon the frictional engagement, the rotation of the hub 2 is slowed, which, in turn, reduces the speed of release or retraction of the line 13.

In one preferred and non-limiting embodiment or aspect, and with reference to FIG. 1, the at least one groove 8 (represented by a line (L1)) extends at angle (B) with respect to a line (L2) connecting a center point (CP1) of the at least one groove 8 and the center axis (A) of the hub. In another preferred and non-limiting embodiment or aspect, the angle (B) is an acute angle, and the degree of the acute angle is selected such that the speed at which the at least one brake shoe 5 moves from the inactivated position to the activated position when the hub 2 moves in the second rotational direction is greater than the speed at which the at least one brake shoe 5 moves from the inactivated position to the activated position. In another preferred and non-limiting embodiment or aspect, the angle (B) is an acute angle in the range of about 0° to about 60°, and in another preferred and non-limiting embodiment or aspect, the angle (B) is in the range of about 15° to about 30°. In another preferred and non-limiting embodiment or aspect, the speed reducer arrangement 200 includes a plurality of brake shoes 5 radially spaced about the center axis (A) of the hub 2, and the angle (B) for each of the plurality of brake shoes 5 is substantially identical. Based upon the angle (B) selected, and in one preferred and non-limiting embodiment or aspect, the force of engagement or contact between the at least one brake shoe 5 and the at least one contact surface 32 of the line retraction device 100 is proportional to the speed at which the hub 2 is rotating. In one preferred and non-limiting embodiment or aspect, the length of the at least one groove 8 is in the range of about ½ to about ⅘ the radial length (L5) of the at least one brake shoe 5.

Figure 3:
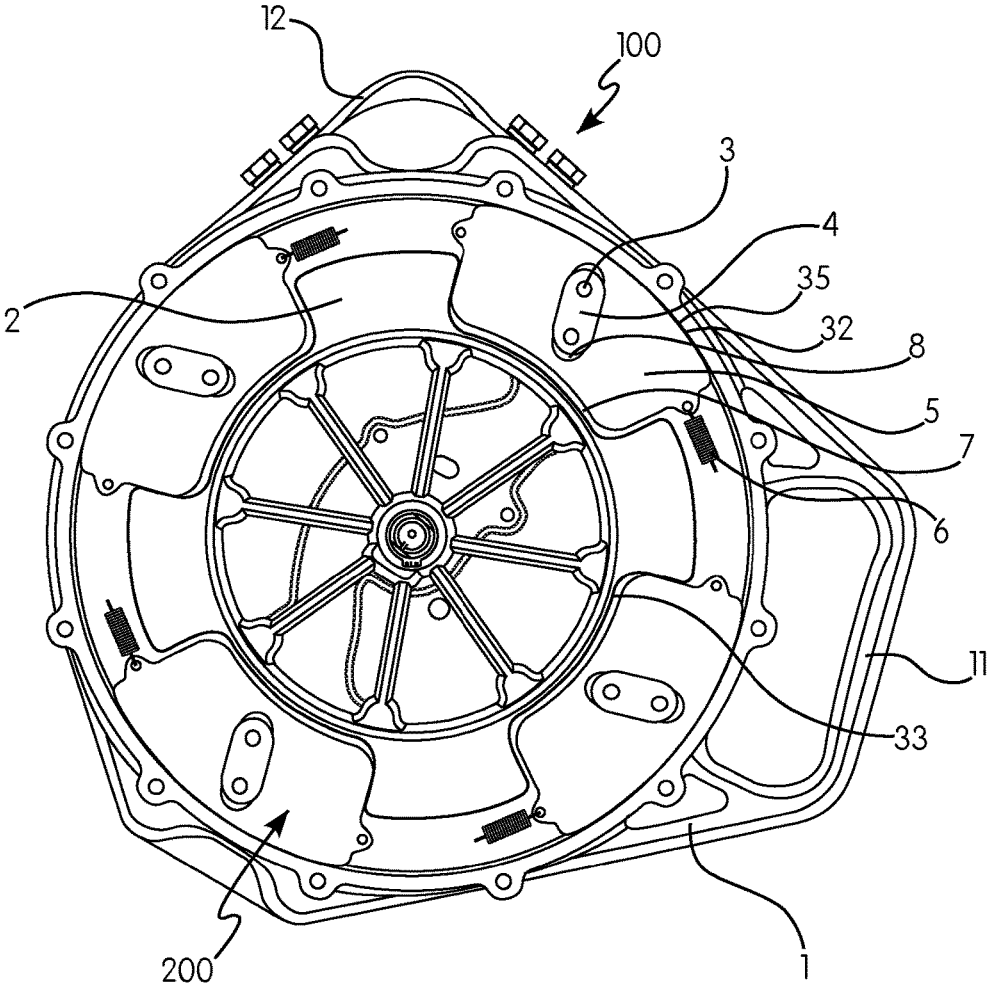
FIG. 3 is a schematic view of the line retraction device with a speed reducer arrangement of FIG. 1 in an activated position.
Figure 4:
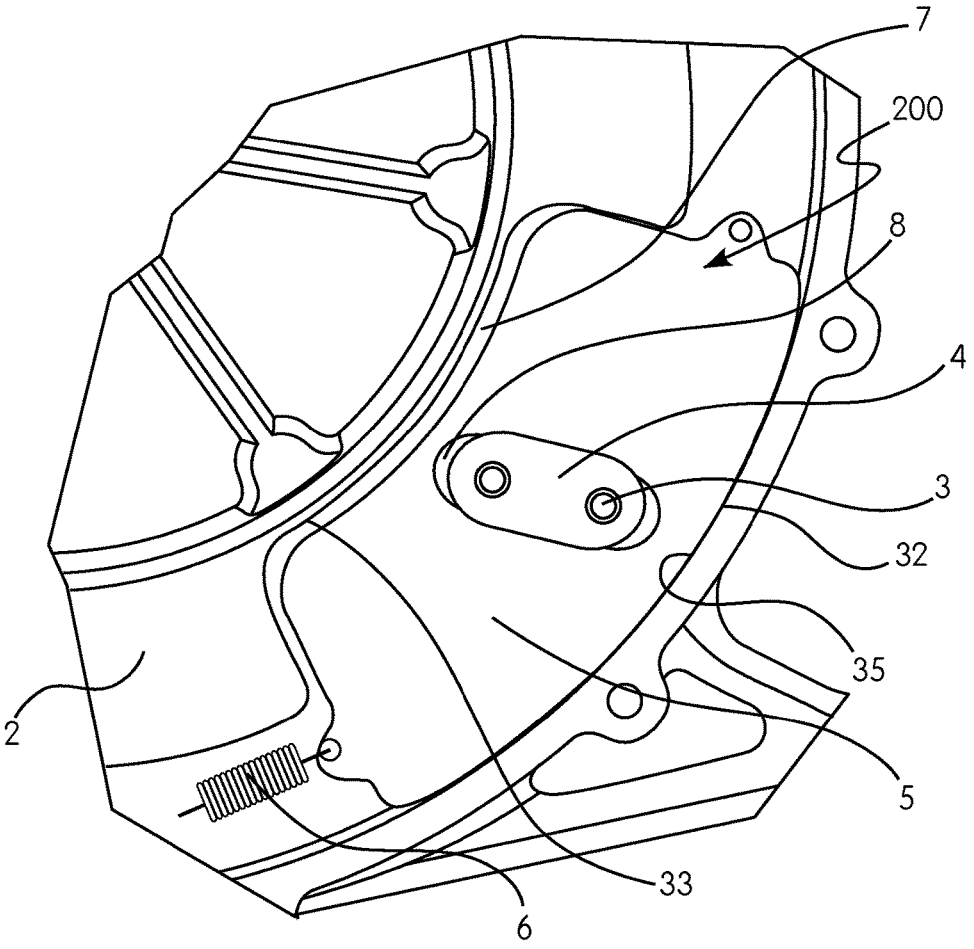
FIG. 4 is a partial enlarged view of the line retraction device with a speed reducer arrangement of FIG. 3.
Figure 5:
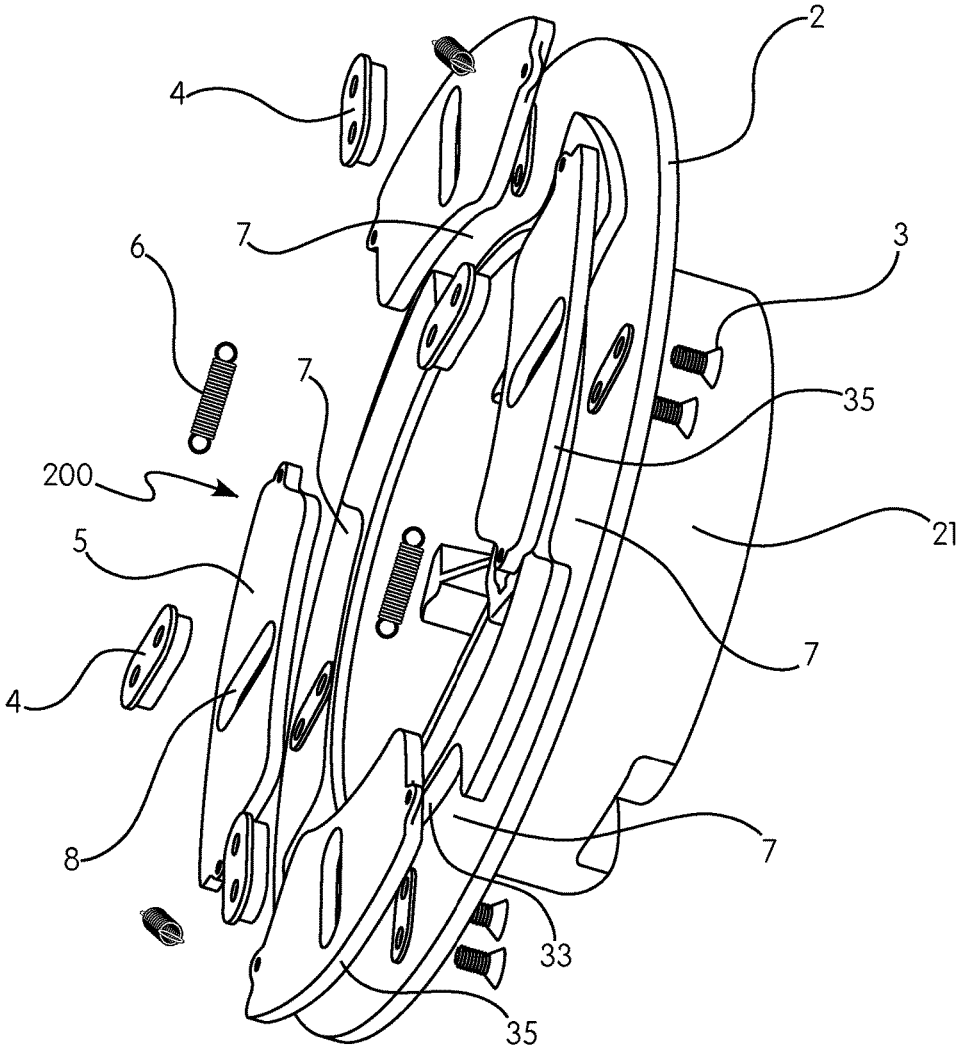
FIG. 5 is an exploded, perspective view of the line retraction device with a speed reducer arrangement of FIG. 1.
Figure 6:
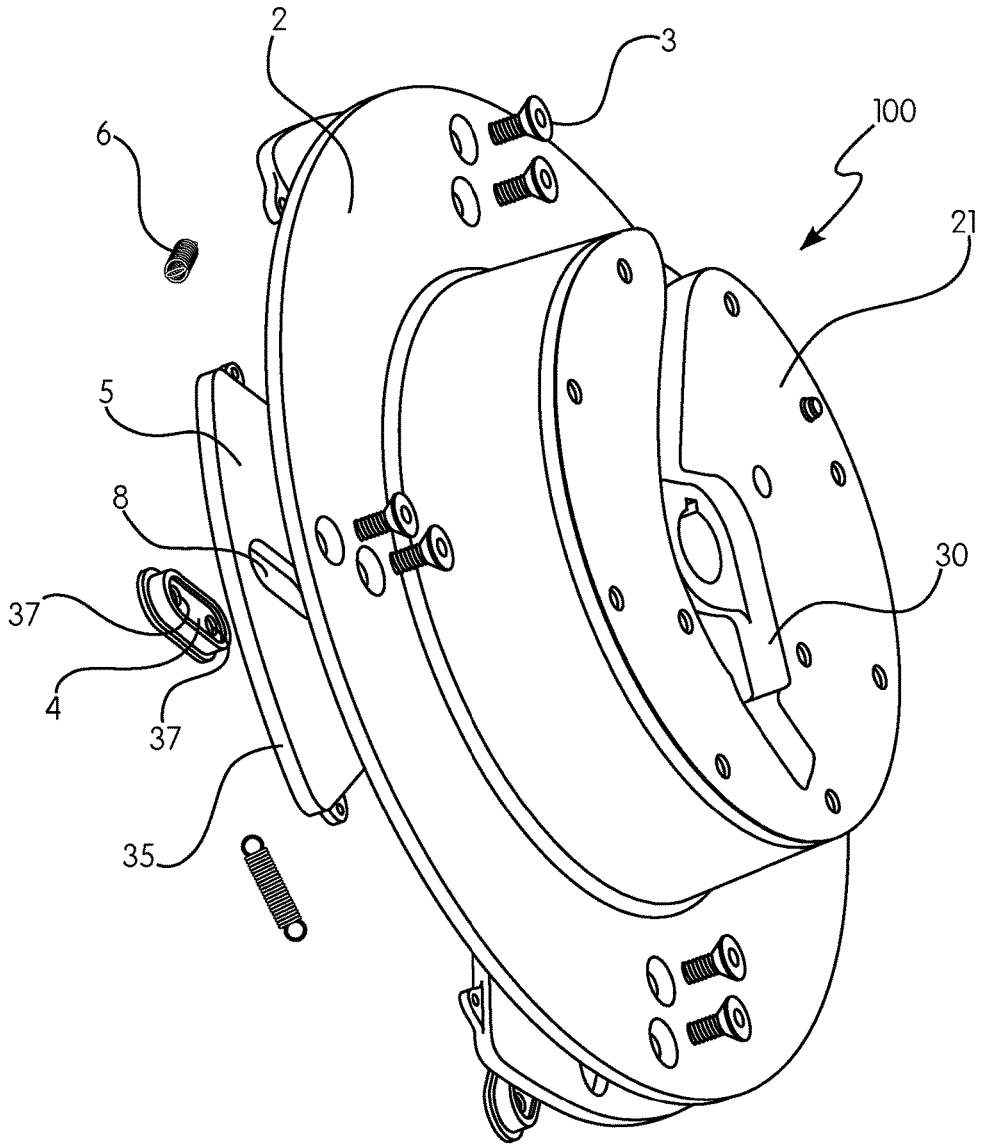
FIG. 6 is an exploded, perspective view of the line retraction device with a speed reducer arrangement of FIG. 1.
Figure 7:
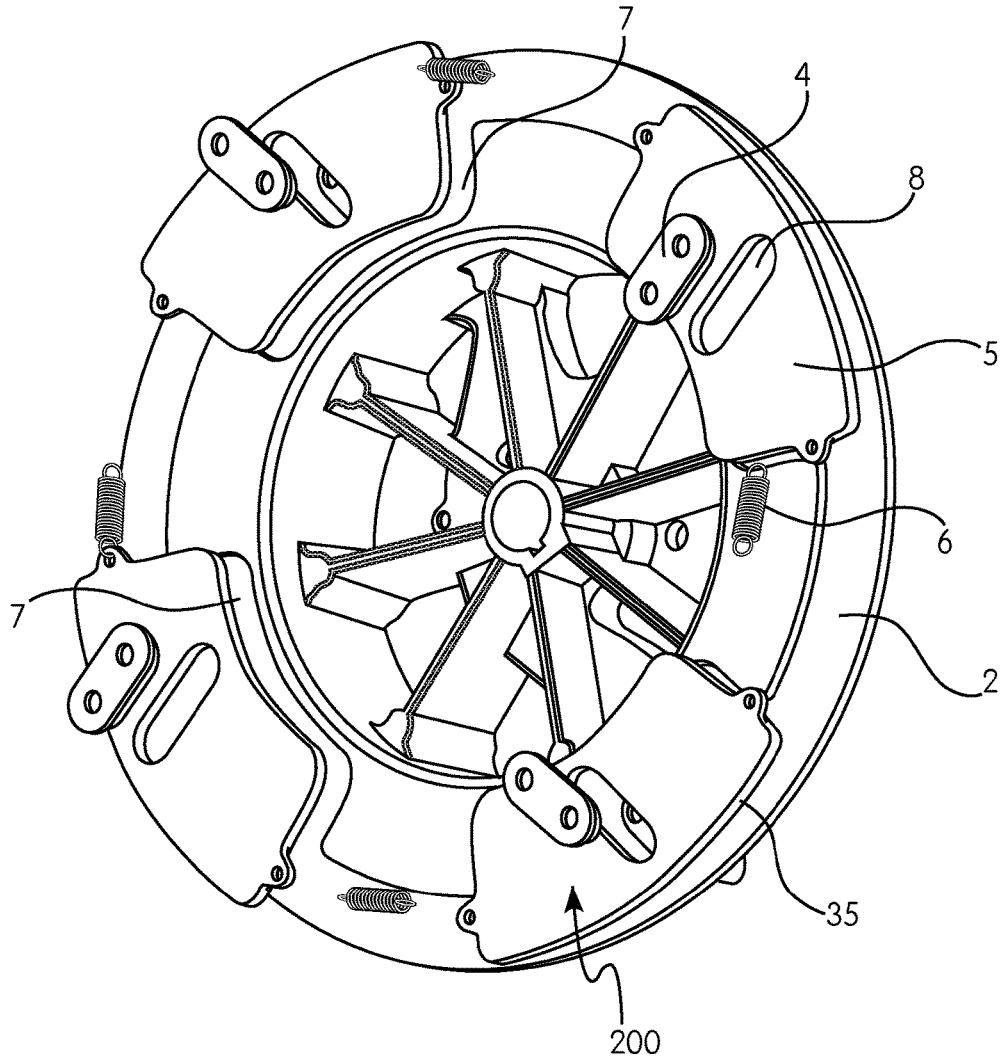
FIG. 7 is an exploded, perspective view of the line retraction device with a speed reducer arrangement of FIG. 1.
Figure 11:
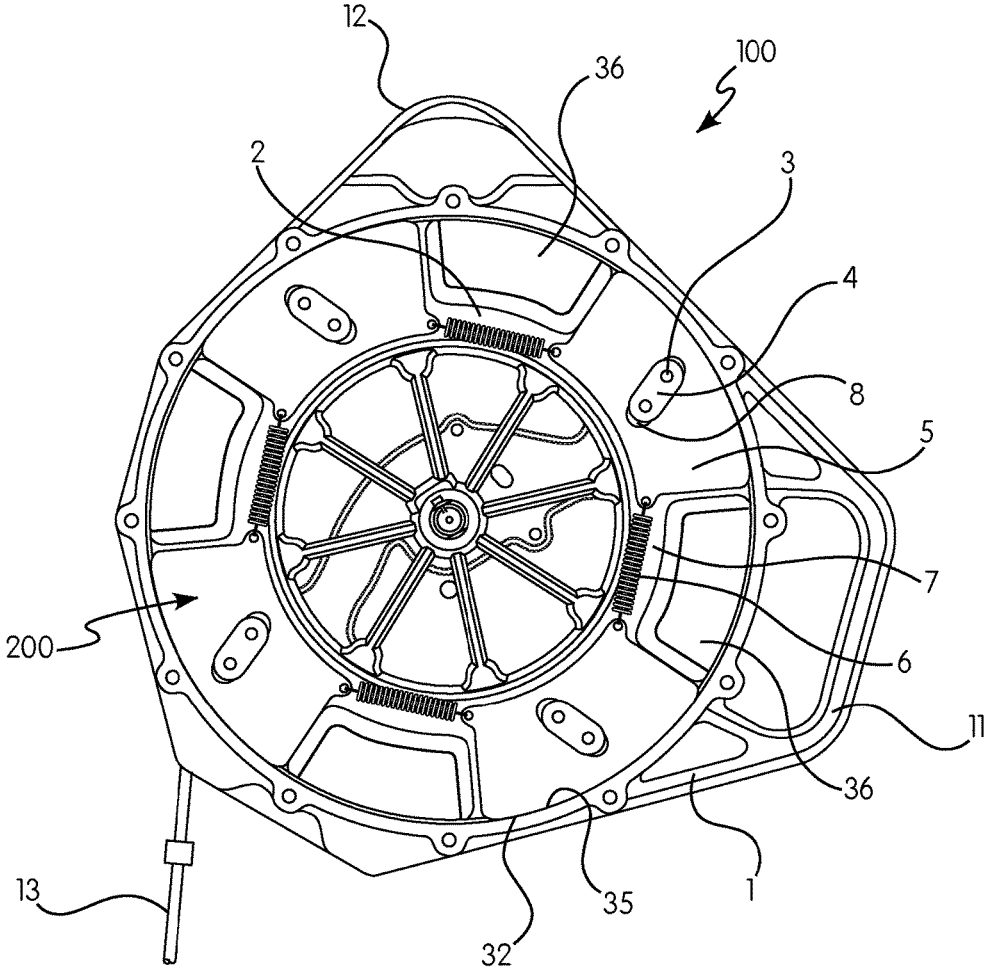
FIG. 11 is a schematic view of the line retraction device with a speed reducer arrangement of FIG. 9 in an activated position.
Figure 12:
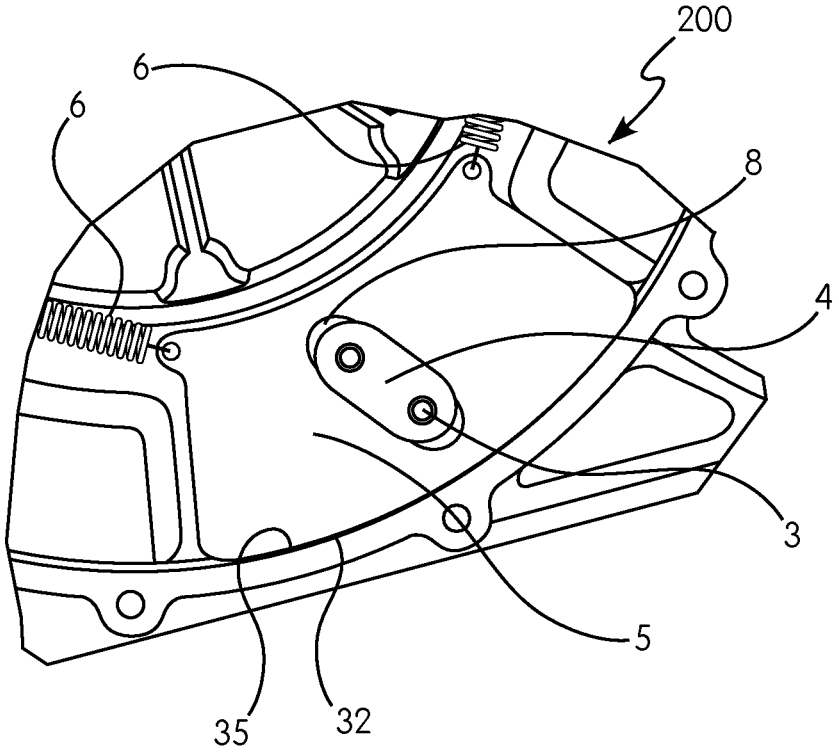
FIG. 12 is a partial enlarged view of the line retraction device with a speed reducer arrangement of FIG. 11.

With reference to FIGS. 1-5 and 9-13, and in one preferred and non-limiting embodiment or aspect, the speed reducer arrangement 200 includes at least one holding groove 7 configured to receive the at least one brake shoe 5, such that the at least one brake shoe 5 can slide from the inactivated position to the activated position. In another preferred and non-limiting embodiment or aspect, and as illustrated in FIGS. 3 and 11, the speed reducer arrangement 200 includes a plurality of holding grooves 7 configured to receive a respective one of a plurality brake shoes 5, wherein an angle (C) between a line (L3) connecting a center point (CP2) of each of adjacent holding grooves 7 and a line (L4) connecting the center axis (A) of the hub 2 is about 90°. In another preferred and non-limiting embodiment or aspect, and with reference to FIG. 1, the radial length (L5) of the at least one brake shoe 5 is from about 1 mm to about 5 mm shorter than the radial distance (L6) from a bottom edge 33 of the at least one holding groove 7 and the at least one contact surface 32 of the line retraction device 100. In the preferred and non-limiting embodiment or aspect of FIGS. 9-13, the holding grooves 7 are formed by two adjacent guide members 36. Generally, these holding grooves 7 are sized and shaped so as to at least partially constrain and facilitate the guided movement of the brake shoes 5 from the inactivated position to the activated position.

In one preferred and non-limiting embodiment or aspect, the at least one biasing member 6 is attached between at least a portion of the at least one brake shoe 5 and at least one of the following: at least a portion of the hub 2, at least a portion of at least one other brake shoe 5, or any combination thereof, such that the at least one brake shoe 5 is urged towards the inactivated position. In one preferred and non-limiting embodiment or aspect, the at least one biasing member 6 is in the form of at least one spring 34. As illustrated in the embodiment of FIGS. 1-8, and in one preferred and non-limiting embodiment or aspect, the at least one biasing member 6, e.g., a spring 34, is attached between at least one brake shoe 5 and a surface of the hub 2. As illustrated in the embodiment of FIGS. 9-13, and in one preferred and non-limiting embodiment or aspect, the at least one biasing member 6, e.g., a spring 34, is attached between two (preferably adjacent) brake shoes 5.

With reference to FIGS. 1, 2, 5, 6, 7 and 8, and in one preferred and non-limiting embodiment or aspect, the speed reducer arrangement includes four holding grooves 7 arranged on the radial direction of the hub 2, where these holding grooves 7 are formed by the guide members 36 in the embodiment of FIGS. 9-13. As discussed above, the angle (C) between the connection line (L3) and line (L4) connecting with the center axis (A) may be 90°, which provides an evenly spaced layout on the circumference of the hub 2. Such holding grooves 7 also provide improved positioning of the brake shoes 5. In one preferred and non-limiting embodiment or aspect, the lugs 4 have an elongated, linear shape with screw holes 37 (see FIGS. 6 and 13) at both ends, which can be fixed to the hub 2 by screws 3. In a further preferred and non-limiting embodiment or aspect, one end of the at least one biasing member 6 is attached to the hub 2, and the other end of the at least one biasing member 6 is attached to a surface of the at least one brake shoe 5 on a non-axis side by the division of the extension line of the at least one groove 8. Therefore, the radial force towards the central axis (A), caused by the at least one biasing member 6, urges the at least one brake shoe 5 toward the central axis (A), and functions to reset the at least one brake shoe 5 to the inactivated position.

As discussed above, and as illustrated in FIGS. 9-13 in one preferred and non-limiting embodiment or aspect, the speed reducer arrangement 200 includes four brake shoes 5. However, in this embodiment or aspect, the at least one biasing member 6 (e.g., a spring 34) is attached between adjacent ends of adjacent brake shoes 5. Accordingly, in this embodiment or aspect, the members 6 are not attached to the hub 2, and are simple to install and maintain. When both the left and right end of a brake shoe 5 is affected by two members 6 on the circumference, the resultant force produced by members 6 is towards the central axis (A) of the hub 2, thus effectively resetting the brake shoes 5 to the inactivated position. Further, and as discussed above, the embodiment of FIGS. 9-13 include guide members 36 that at least partially bound and define the holding grooves 7.

As discussed above, when the at least one brake shoe 5 is positioned nearest to the central axis (A), e.g, the shaft 10, in the inactivated position, such as under the urging of the at least one biasing member 6, a radial gap exists between the at least one brake shoe 5 and the at least one contact surface 32 of the housing 1 of the line retraction device 100. In one preferred and non-limiting embodiment or aspect, the gap is in the range of between about 1 mm to about 5 mm. In one preferred and non-limiting embodiment or aspect, the at least one groove is an elongated groove extending through the at least one brake shoe 5. Further, in one preferred and non-limiting embodiment or aspect, the line (L2) connecting the center point (CP) of the at least one groove 8 and the central axis (A) (e.g., the shaft 10) is set as a start edge and the length direction (L1) of the at least one groove 8 is set as a terminal edge. In this embodiment or aspect, the terminal edge always deflects to the same rotational (e.g., clockwise or counterclockwise) direction as the start edge.

As discussed above, the line retraction device 100 and speed reducer arrangement 200 of the present invention provide a reduction in the speed of the hub 2 in both rotational directions (e.g., releasing and retracting) when the at least one brake shoe 5 moves from the inactivated position to the activated position.

With respect to FIGS. 1, 2, 9, and 10, and in one preferred and non-limiting embodiment or aspect, when the hub 2 of the speed reducer arrangement 200 of the present invention is stationary, the length direction of the at least one groove of the at least one brake shoe 5 deflects the line (L2) connecting the at least one groove 8 and the central axis (A) of the hub 2. In this manner, the at least one biasing member 6 generates a radial force towards the central axis (A) and pulls the at least one brake shoe 5 towards the central axis (A), thereby retaining the at least one brake shoe 5 in the inactivated position, i.e., the position nearest to the central axis (A).

In one preferred and non-limiting embodiment or aspect, during the process of retracting the line 13, the hub 2 rotates in the first rotational direction, e.g., the clockwise direction, and when the speed of retracting is relatively low, the structure status of the speed reducer arrangement 200 (as illustrated in FIGS. 1, 2, 9, and 10) is in the inactivated position. Though the at least one brake shoe 5 is urged away from the central axis (A) by the centrifugal force, when the rotating speed of the hub 2 is lower, the centrifugal force is too low to overcome the radial force towards the central axis (A) provided by the at least one biasing member 6. Accordingly, the radial gap is maintained between the at least one brake shoe 5 and the at least one contact surface 32 of the housing 1 of the line retraction device 100, such that there will be no contact (or frictional engagement). However, when the speed of retracting the line 13 is higher, the structure status of the speed reducer arrangement 200 (as illustrated in FIGS. 3, 4, 10, and 11) is in the activated position. In this manner, the rotating speed of the hub 2 is higher, and, therefore, the centrifugal force on the at least one brake shoe 5 is higher. When the centrifugal force is high enough to overcome the radial force towards the central axis (A) provided by the at least one biasing member 6, the at least one brake shoe 5 will slide along the at least one groove 8 away from the central axis (A) of the hub 2 under the constraint of the at least one lug 4. When the at least one brake shoe 5 contacts the housing 1, frictional engagement will occur between the at least one brake shoe 5 and the at least one contact surface 32. Accordingly, this engagement will lead to deceleration of the at least one brake shoe 5, and since the at least one lug 4 is fixed to the at least one hub 2, which is restrained in the at least one groove 8, the speed of the hub 2 will correspondingly decrease at the same pace as the at least one brake shoe 5.

In this embodiment or aspect, the faster the hub 2 is rotating, the higher the centrifugal force that will be applied on the at least one brake shoe 5. Since friction is in direct proportion to normal pressure, the friction between the at least one brake shoe 5 and the at least one contact surface 32 increases due to the increasing force of the normal pressure. Accordingly, the speed reducer arrangement 200 provides higher friction resistance when the hub 2 is rotating at a high rotating speed. One or both of the contact edge 35 of the at least one brake shoe 5 and the at least one contact surface 32 of the line retraction device 100 may be manufactured from or coated with a material with a high coefficient of friction. When the rotating speed of the hub 2 becomes lower, the frictional resistance becomes lower, such that the at least one brake shoe 5 will move back to the inactivated position, since the centrifugal force is too low to overcome the radial force towards the central axis (A) provided by the at least one biasing member 6. The process of retracting the line 13 illustrates how the speed reducer arrangement 200 automatically and proportionately adjusts the deceleration friction resistance with the change of the rotating speed of the hub 2, to ensure the decelerating effect results in a uniform (or constant) retraction speed.

In one preferred and non-limiting embodiment or aspect, during the process of releasing, or paying out, the line 13, the hub 2 rotates in the second rotational direction, e.g., the counterclockwise direction, and when the speed of releasing is relatively low, the structure status of the speed reducer arrangement 200 is illustrated in FIGS. 1, 2, 9, and 10. Though the at least one brake shoe 5 is urged away from the central axis (A) due to the centrifugal force, when the rotating speed of the hub 2 is lower, the centrifugal force is too low to overcome the radial force towards the central axis (A) provided by the at least one biasing member 6. Therefore, the radial gap exists between the at least one brake shoe 5 and the at least one contact surface 32 of the line retraction device 200, such that no contact will occur. However, as discussed above, when the speed of releasing is higher, the structure status of the speed reducer arrangement 200 is illustrated in FIGS. 3, 4, 10, and 11. In this case, the rotating speed of the hub 2 is higher, and therefore, the centrifugal force on the at least one brake shoe 5 is higher. When the centrifugal force is high enough to overcome the radial force towards the central axis (A) provided by the at least one biasing member 6, the at least one brake shoe 5 will slide along the at least one groove 8 away from the central axis (A) of the hub 2 under the constraint of the at least one lug 4 to the activated position, thereby providing engagement and deceleration of the at least one brake shoe 5 due to the frictional resistance, which, as discussed above, is automatically proportional. Also, and again, when the rotating speed of the hub 2 becomes lower, the friction resistance becomes lower, and the at least one brake shoe 5 moves back to the inactivated position nearest to the central axis (A) when the centrifugal force is too small to overcome the radial force towards the central axis (A) provided by the at least one biasing member 6.

In one preferred and non-limiting embodiment or aspect, the critical speed to move the at least one brake shoe 5 from the position nearest to the central axis (A) during the process of releasing the line 13 is higher than the critical speed to move the at least one brake shoe 5 from the position nearest to the central axis (A) during the process of retracting the line 13. The difference between the releasing critical speed and the retracting critical speed increases with the increase of the degree of the angle (B). This effect is realized, since, in one preferred and non-limiting embodiment or aspect, when the hub 2 is rotating in the first rotational direction, e.g., the clockwise direction, the speed reducer arrangement 200 increases the effect of the at least one brake shoe 5 moving to the activated position, because the at least one brake shoe 5 experiences the counterclockwise circumferential force from the direction of the at least one groove 8 to move away from the central axis (A), as well as the centrifugal force to radially move away from the central axis (A). Conversely, when the hub 2 is rotating in the second rotational direction, e.g., the counterclockwise direction, the speed reducer arrangement 200 decreases the effect of the at least one brake shoe 5 moving away from the central axis (A), because the at least one brake shoe 5 experiences the clockwise circumferential force from the direction of the at least one groove 8 to move toward the central axis (A), as well as the centrifugal force to radially move away from the central axis (A). Therefore, the difference between the releasing critical speed and the retracting critical speed can be effectively adjusted by adjusting the degree of the angle (B). More specifically, the larger the degree of the acute angle (B), the larger the difference in critical speeds.

In one preferred and non-limiting embodiment or aspect, and when the speed reducer arrangement 200 of the present invention is used in practice, the application where the hub 2 is rotating in a high speed normally happens during the process of retracting the line 13 by the winding section 21, which typically occurs automatically. Therefore, it is preferable and beneficial to restrain the line 13 retracting speed during the automatically retracting process, so as to prevent the potential damage to the hub 2 or other connecting components. However, when releasing the line 13 from the winding section 21, the releasing process is typically gradual, such that it is not essential to restrain the line 13 releasing speed. Therefore, the difference between the two critical speeds during the process of releasing and retracting can be utilized and effectively adjusted by adjusting the degree of the angle (B).

Accordingly, the present invention provides an improved line retraction device 100 and speed reducer arrangement 200 for use in a variety of applications and environments.

For purposes of summarizing the invention, certain aspects, features and advantages of the invention have been described. It is herein to be understood that not all advantages of this invention can be achieved in relation to any particular embodiment. As such, the invention can be embodied in configurations to optimize one or various advantages. Applications of the invention can be indicated for any one advantage, or combination of advantages, as indicated for implementation.

While several embodiments of the line retraction device and speed reducer arrangement are shown in the accompanying figures and described hereinabove in detail, other embodiments will be apparent to, and readily made by, those skilled in the art without departing from the scope and spirit of the invention. For example, it is to be understood that this disclosure contemplates that, to the extent possible, one or more features of any embodiment or aspect can be combined with one or more features of any other embodiment or aspect. Accordingly, the foregoing description is intended to be illustrative rather than restrictive.

What is claimed is:

1. A speed reducer arrangement for a line retraction device having a hub configured to rotate about a center axis and having a line associated therewith, the line including a first end directly or indirectly attached to the hub and a second end opposite the first end, and at least one retraction member biasing the hub in a first rotational direction of the hub opposite a second rotational direction of the hub, wherein the hub is configured to: (i) retract the line when the hub moves in the first rotational direction; and (ii) release the line when the hub moves in the second rotational direction, wherein the speed reducer arrangement comprises:

at least one lug fixed on a surface of the hub and configured to rotate along with the hub;

at least one brake shoe having at least one groove extending therethrough and configured to at least partially receive the at least one lug, such that, as the hub rotates, the at least one brake shoe is configured to slidably move along the at least one groove from an inactivated position, wherein the at least one brake shoe is located nearest the center of the hub, to an activated position, wherein the at least one brake shoe contacts at least one contact surface of the line retraction device to thereby slow the rotation of the hub; and at least one biasing member configured to urge the at least one brake shoe towards the inactivated position, wherein the at least one biasing member is attached to and in tension with the at least one brake shoe.

2. The speed reducer arrangement of claim 1, wherein the line retraction device comprises at least one housing at least partially surrounding the hub, and wherein the at least one contact surface comprises at least one surface of the at least one housing.

3. The speed reducer arrangement of claim 1, wherein the at least one groove extends at an angle with respect to a line connecting a center point of the at least one groove and the center axis of the hub.

4. The speed reducer arrangement of claim 3, wherein the angle is an acute angle, and wherein the degree of the acute angle is selected such that the speed at which the at least one brake shoe moves from the inactivated position to the activated position when the hub moves in the second rotational direction is greater than the speed at which the at least one brake shoe moves from the inactivated position to the activated position.

5. The speed reducer arrangement of claim 3, wherein the angle is an acute angle in the range of about 0° to about 60°.

6. The speed reducer arrangement of claim 3, further comprising a plurality of brake shoes radially spaced about the center axis of the hub, wherein the angle for each of the plurality of brake shoes is substantially identical.

7. The speed reducer arrangement of claim 1, wherein the force of engagement between the at least one brake shoe and the at least one contact surface of the line retraction device is proportional to the speed at which the hub is rotating.

8. The speed reducer arrangement of claim 1, further comprising at least one holding groove configured to receive the at least one brake shoe, such that the at least one brake shoe can slide from the inactivated position to the activated position.

9. The speed reducer arrangement of claim 8, further comprising a plurality of holding grooves configured to receive a respective one of a plurality brake shoes, wherein the angle between a line connecting a center point of each of adjacent holding grooves and the center axis of the hub is about 90°.

10. The speed reducer arrangement of claim 8, wherein the radial length of the at least one brake shoe is from about 1 mm to about 5 mm shorter than the radial distance from a bottom edge of the at least one holding groove and the at least one contact surface of the line retraction device.

11. The speed reducer arrangement of claim 1, wherein the at least one biasing member is attached between at least a portion of the at least one brake shoe and at least one of the following: at least a portion of the hub, at least a portion of at least one other brake shoe, or any combination thereof, such that the at least one brake shoe is urged towards the inactivated position.

12. The speed reducer arrangement of claim 1, further comprising a plurality of brake shoes radially spaced about the center axis of the hub, wherein the at least one biasing member comprises a plurality of biasing members, each of which is attached between two of the plurality of brake shoes.

13. The speed reducer arrangement of claim 1, wherein the length of the at least one groove is in the range of about ½ to about ⅘ the radial length of the at least one brake shoe.

14. The speed reducer arrangement of claim 1, wherein the at least one lug is fixed to the surface of the hub by at least one attachment member.

15. The speed reducer arrangement of claim 1, wherein the at least one biasing member is at least one spring.

16. A line retraction device, comprising:

a hub configured to rotate about a center axis and having a line associated therewith, the line including a first end directly or indirectly attached to the hub and a second end opposite the first end;

at least one retraction member biasing the hub in a first rotational direction of the hub opposite a second rotational direction of the hub, wherein the hub is configured to: (i) retract the line when the hub moves in the first rotational direction; and (ii) release the line when the hub moves in the second rotational direction; and a speed reducer arrangement, comprising:

(i) at least one lug fixed on a surface of the hub and configured to rotate along with the hub;

(ii) at least one brake shoe having at least one groove extending therethrough and configured to at least partially receive the at least one lug, such that, as the hub rotates, the at least one brake shoe is configured to slidably move along the at least one groove from an inactivated position, wherein the at least one brake shoe is located nearest the center of the hub, to an activated position, wherein the at least one brake shoe contacts at least one contact surface of the line retraction device to thereby slow the rotation of the hub; and (iii) at least one biasing member configured to urge the at least one brake shoe towards the inactivated position, wherein the at least one biasing member is attached to and in tension with the at least one brake shoe.

17. The line retraction device of claim 16, further comprising at least one housing at least partially surrounding the hub, and wherein the at least one contact surface comprises at least one surface of the at least one housing.

18. The line retraction device of claim 16, wherein the force of engagement between the at least one brake shoe and the at least one contact surface of the line retraction device is proportional to the speed at which the hub is rotating.

19. The line retraction device of claim 16, wherein the at least one groove extends at an angle with respect to a line connecting a center point of the at least one groove and the center axis of the hub.

20. The speed reducer arrangement of claim 19, wherein the angle is an acute angle, and wherein the degree of the acute angle is selected such that the speed at which the at least one brake shoe moves from the inactivated position to the activated position when the hub moves in the second rotational direction is greater than the speed at which the at least one brake shoe moves from the inactivated position to the activated position.

* * * * *